US011833100B1

(12) United States Patent
Liu

(10) Patent No.: US 11,833,100 B1
(45) Date of Patent: Dec. 5, 2023

(54) STIMULATION DEVICE

(71) Applicants: HYTTO PTE. LTD., Singapore (SG); DONGGUAN AISI HEALTH CARE PRODUCTS CO., LTD., Dongguan (CN)

(72) Inventor: Dan Liu, Guangzhou (CN)

(73) Assignee: Hytto PTE. LTD., Singapore (SG)

( * ) Notice: Subject to any disclaimer, the term of this patent is extended or adjusted under 35 U.S.C. 154(b) by 0 days.

(21) Appl. No.: 18/153,423

(22) Filed: Jan. 12, 2023

(51) Int. Cl.
*A61H 19/00* (2006.01)
*A61H 9/00* (2006.01)

(52) U.S. Cl.
CPC ..... *A61H 19/34* (2013.01); *A61H 9/0057* (2013.01); *A61H 2201/1215* (2013.01); *A61H 2201/1436* (2013.01); *A61H 2201/1669* (2013.01)

(58) Field of Classification Search
CPC ..... A61H 19/00–50; A61H 9/0057; A61H 23/00–06; A61H 2023/002–045
See application file for complete search history.

(56) References Cited

U.S. PATENT DOCUMENTS

| | | | | |
|---|---|---|---|---|
| 7,670,280 | B2 | 3/2010 | Gloth | |
| 8,870,746 | B2 | 10/2014 | Carlson | |
| 11,452,665 | B1 * | 9/2022 | Yu | A61H 9/0057 |
| 2020/0085681 | A1 * | 3/2020 | Haddock | A61H 9/005 |
| 2022/0015983 | A1 * | 1/2022 | Li | A61H 23/0218 |
| 2022/0175612 | A1 * | 6/2022 | Witt | A61H 9/0057 |
| 2022/0409470 | A1 * | 12/2022 | He | F04B 35/01 |
| 2023/0027905 | A1 * | 1/2023 | Yu | A61H 23/006 |
| 2023/0048210 | A1 * | 2/2023 | Chen | A61H 7/001 |

FOREIGN PATENT DOCUMENTS

| | | | |
|---|---|---|---|
| CA | 2528828 | C | 11/2011 |

OTHER PUBLICATIONS

Definition of "socket" from Merriam-Webster Online Dictionary. <https://www.merriam-webster.com/dictionary/socket>. Accessed on Apr. 27, 2023. (Year: 2023).*

Guess, Marsha K. MD, Connell, Kathleen A. MD Chudnoff, Scott MD Adekoya, Olusola MD Richmond, Cherrilyn Aprn Nixon, Kayla E. MD Freeman, Katherine Drph Melman, Arnold MD, The Effects of a Genital Vibratory Stimulation Device on Sexual Function and Genital Sensation, Female Pelvic Medicine & Reconstructive Surgery 23(4):p. 256-262, Jul. 8, 2017, United States of America.

Tuuli M. Kukkonen, Devices and Methods to Measure Female Sexual Arousal, Sexual Medicine Reviews, vol. 3, Issue 4, Oct. 2015, pp. 225-244, Oct. 1, 2015, Canada.

* cited by examiner

*Primary Examiner* — Valerie L. Woodward
*Assistant Examiner* — Paige Kathleen Bugg
(74) *Attorney, Agent, or Firm* — Kanika Radhakrishnan; Evergreen Valley Law Group

(57) ABSTRACT

Embodiments of the present disclosure disclose a stimulation device. The stimulation device includes a pressure generator comprising a chamber including a bottom wall and an opening configured to engage a portion of a body of a user, a drive unit, and a linear reciprocating mechanism. The drive unit is configured to cause reciprocating motion of the bottom wall via the linear reciprocating mechanism, thereby resulting in a changing volume of the chamber. The pressure generator further comprises a stationary sleeve and a motional sleeve, with motional sleeve disposed between the stationary sleeve and the bottom wall, such that, stationary sleeve and the motional sleeve are concentric with each other and define the chamber with the bottom wall.

18 Claims, 6 Drawing Sheets

STIMULATION DEVICE

TECHNICAL FIELD

The present disclosure relates to sexual pleasure devices and, more particularly relates to the massagers or toys for engaging and sexually stimulating the human body, particularly the clitoris.

BACKGROUND ART

The clitoris has an abundance of nerve endings and is the most sensitive erogenous zone of the body of human females. The clitoris is generally the primary anatomical source of sexual pleasure for the human female. When sexually stimulated, the clitoris may incite female sexual arousal. Sexual stimulation, including arousal, may result from mental stimulation, foreplay with a sexual partner, or masturbation, and can lead to orgasm. The most effective sexual stimulation of the organ is usually done manually or orally (cunnilingus), which is often referred to as direct clitoral stimulation. In cases involving sexual penetration, these activities may also be referred to as additional or assisted clitoral stimulation. Moreover, due to the high sensitivity of the glans, direct stimulation to it is not always pleasurable, instead, direct stimulation to the hood or the areas near the glans is often more pleasurable, with the majority of women preferring to use the hood to stimulate the glans, or to have the glans rolled between the lips of the labia, for indirect touch.

Therefore, the erogenous zones of the human body can be stimulated with a variety of tools. For example, vibrators are used to apply a stimulus to a particular area of the skin by direct contact. However, vibrators of stimulation can lead to irritations or inflammations of the skin. Also, direct contact of the genital area with such tools for individual reasons of hygiene or due to personal reservations, for example, may not be desired.

SUMMARY OF THE DISCLOSURE

According to an aspect of the present disclosure, there is provided a stimulation device. The stimulation device includes a pressure generator including a chamber, and an opening being a sole opening of the chamber to the exterior of the pressure generator. The opening is configured to engage a portion of the body of the user. The chamber is defined by a movable container and a stationary sleeve socketed by the movable container. The stimulation device further includes a drive unit and a linear reciprocating mechanism. The drive unit is configured to cause reciprocating motion of the movable container via the linear reciprocating mechanism, thereby resulting in a changing volume of the chamber.

In one embodiment, the movable container includes a motional sleeve fixed at the bottom of the motional sleeve, the motional sleeve is disposed between the stationary sleeve and the bottom wall, the stationary sleeve is socketed by the motional sleeve.

In one embodiment, a width of a gap between the stationary sleeve and the movable container is less than 0.1 mm. In one embodiment, the width of the gap between the stationary sleeve and the movable container lies in the range of about 0.02 mm to 0.05 mm.

In one embodiment, the drive unit is a motor and the linear reciprocating mechanism is a crank-link mechanism, a connecting rod of the crank-link mechanism is connected with the bottom of the movable container, thereby causing the movable container to reciprocate when the crank of the crank-link mechanism is rotating with the motor.

According to another aspect of the present disclosure, there is provided a stimulation device. The stimulation device includes a pressure generator comprising a chamber including a bottom wall and an opening configured to engage a portion of a body of a user. Further, the stimulation device includes a drive unit and a linear reciprocating mechanism, wherein the drive unit is configured to cause reciprocating motion of the bottom wall via the linear reciprocating mechanism, thereby resulting in a changing volume of the chamber. The pressure generator further comprises a stationary sleeve and a motional sleeve, with motional sleeve disposed between the stationary sleeve and the bottom wall, such that, stationary sleeve and the motional sleeve are concentric with each other and define the chamber with the bottom wall.

In one embodiment, the stimulation device may include a movable container. The movable container may include a motional sleeve and a bottom wall fixed at the bottom of the motional sleeve, the motional sleeve disposed between the stationary sleeve and the bottom wall, the stationary sleeve is socketed by the motional sleeve, such that, stationary sleeve and the motional sleeve may be concentric with each other and define the chamber with the bottom wall. The drive unit is configured to cause reciprocating motion of the movable container via the linear reciprocating mechanism.

In one embodiment, the stationary sleeve and the motional sleeve may be made of metal, the outer edges of the motional sleeve and the bottom wall may be assembled by wrapping a layer of plastic.

In one embodiment, the linear reciprocating mechanism may be selected from a group consisting of a ball screw mechanism, a belt-drive linear actuator, a linear motor, a slider-crank mechanism, a hydraulic linear actuator, and a pneumatic linear actuator.

In one embodiment, a width of a gap between the stationary sleeve and the motional sleeve may be less than 0.1 mm. As a result, the gap between the stationary sleeve and the movable container is less than 0.1 mm. In one embodiment, the width of the gap between the stationary sleeve and the motional sleeve may lie in the range of about 0.02 mm to 0.05 mm.

In one embodiment, the stimulation device may further include a housing enclosing the drive unit, the linear reciprocating mechanism, and a part of the pressure generator.

In one embodiment, the stationary sleeve is held with housing via a holding gasket. A portion of the housing associated with the holding gasket and the stationary sleeve is detachable for accessing the pressure generator.

In one embodiment, the detachable portion of the housing may be attached to the main body of the housing via magnetic fasteners, threaded fasteners or snap-fit fasteners.

In one embodiment, a width of a gap between the motional sleeve and an inner wall of the housing may be greater than 0.1 mm. In one embodiment, the width is greater than 1 mm.

In one embodiment, a width of a gap between the bottom wall and an inner wall of the housing may be greater than 0.1 mm. In one embodiment, the width is greater than 1 mm.

In one embodiment, the drive unit may be a motor and the linear reciprocating mechanism may be a crank-link mechanism.

In one embodiment, a connecting rod of the crank-link mechanism may be connected with the bottom of the bottom wall, thereby causing the bottom wall to reciprocate when the crank of the crank-link mechanism is rotating with the motor. The reciprocation of the bottom wall causes the motional sleeve to reciprocate while the motional sleeve keeps socketing the stationary sleeve.

In one embodiment, the stimulation device may further include a control device configured to receive input from a user and control the drive unit.

In one embodiment, the linear reciprocating mechanism may be in a detachable connection with the pressure generator.

According to another aspect of the present disclosure, there is provided a stimulation device. The stimulation device includes a pressure generator comprising a chamber including a bottom wall and an opening configured to engage a portion of a body of a user. The stimulation device further includes a drive unit and a linear reciprocating mechanism, wherein the drive unit is configured to cause reciprocating motion of the bottom wall via the linear reciprocating mechanism, thereby resulting in a changing volume of the chamber. The stimulation device further includes a housing enclosing the drive unit, the linear reciprocating mechanism and a part of the pressure generator. The pressure generator further comprises a stationary sleeve and a motional sleeve, with motional sleeve disposed between the stationary sleeve and the bottom wall, such that, stationary sleeve and the motional sleeve are concentric with each other and define the chamber with the bottom wall. The stationary sleeve is held with housing via a holding gasket. Also, a portion of the housing associated with the holding gasket and the stationary sleeve is detachable for accessing the pressure generator.

In one embodiment, the detachable portion of the housing may be attached to the main body of the housing via magnetic fasteners, threaded fasteners or snap-fit fasteners.

In the context of the specification, the term "processor" refers to one or more of microprocessors, a microcontroller, a general-purpose processor, a Field Programmable Gate Array (FPGA) or an Application Specific Integrated Circuit (ASIC), and the like.

In the context of the specification, the phrase "memory unit" refers to one or more of a volatile storage memory, such as Static Random Access Memory (SRAM) and Dynamic Random Access Memory (DRAM) of types such as Asynchronous DRAM, Synchronous DRAM, Double Data Rate SDRAM, Rambus DRAM, and Cache DRAM, etc., or a non-volatile storage memory such as EPROM, EEPROM or flash memory or the like.

In the context of the specification, the phrase "communication interface" refers to a device or a module enabling direct connectivity via wires and connectors such as USB, HDMI, VGA, or wireless connectivity such as Bluetooth or Wi-Fi or Local Area Network (LAN) or Wide Area Network (WAN) implemented through TCP/IP, IEEE 802.x, GSM, CDMA, LTE or other equivalent protocols.

BRIEF DESCRIPTION OF THE DRAWINGS

The following detailed description of illustrative embodiments is better understood when read in conjunction with the appended drawings. To illustrate the present disclosure, exemplary constructions of the disclosure are shown in the drawings. However, the present disclosure is not limited to a specific device, or a tool and instrumentalities disclosed herein. Moreover, those in the art will understand that the drawings are not to scale.

Figure 1:
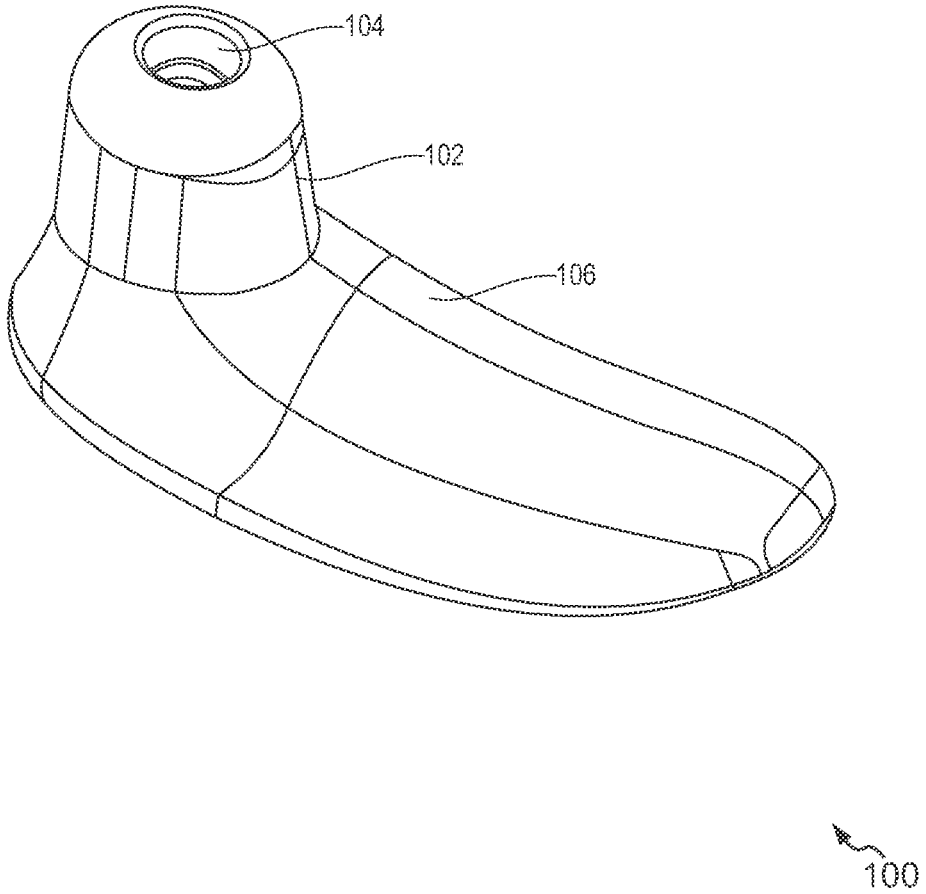
FIG. 1 illustrates a perspective view of the stimulation device in accordance with an embodiment of the present disclosure.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearances of the phrase "in an embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

Various embodiments of the present disclosure provide a stimulation device for sexual stimulation of a body of a user. The stimulation device includes a drive unit operably coupled with a linear reciprocating mechanism. The drive unit may be a motor and the linear reciprocating mechanism may be a crank-link mechanism. Further, the stimulation device includes a pressure generator including a stationary sleeve, a motional sleeve, and a bottom wall. The stationary sleeve and the motional sleeve define a chamber with the bottom wall. The stationary sleeve is stationary with respect to a housing of the stimulation device and is held by a holding gasket. The motional sleeve is configured to reciprocate with the bottom wall. The reciprocation of the bottom wall and the motional sleeve is enabled by the linear reciprocating mechanism. The reciprocating motion of the motional sleeve and the bottom wall with respect to the stationary sleeve causes increase and decrease in the volume of the chamber and the generation of negative and positive relative pressures with respect to the ambient. The negative and positive pressures generate a suction effect in the pressure generator and lead to sexual stimulation of the user when an opening in the chamber is engaged with a portion of the body of the user. In several embodiments, a portion of the housing associated with the stationary sleeve and the holding gasket may be detachable from the main body of the housing. The detachable portion may be attachable to the main body using magnetics, threaded or clips-based snap-fit fasteners.

Various example embodiments of the present disclosure are described hereinafter with reference to FIG. 1 to FIG. 7.

FIG. 1 illustrates a perspective view of the stimulation device 100 in accordance with an embodiment of the present disclosure. FIG. 1 illustrates a pressure generator 102 with an opening 104 in the pressure generator 102. The opening 104 is configured to engage with a portion of the body of a user for providing sexual stimulation to the user. Further, the stimulation device 100 includes a housing 106 that encapsulates at least a part of the pressure generator 102 and other components of the stimulation device 100 which will be introduced in the following discussion. In several embodiments of the disclosure, the housing 106 is made up of a Thermoplastic Elastomer (TPE) material. TPEs combine properties of elastomers such as softness and flexibility with the processing capabilities of the thermoplastics such as recyclability. In that manner, using TPE material for the housing 106 makes the housing 106 soft, flexible and recyclable.

Figure 2:
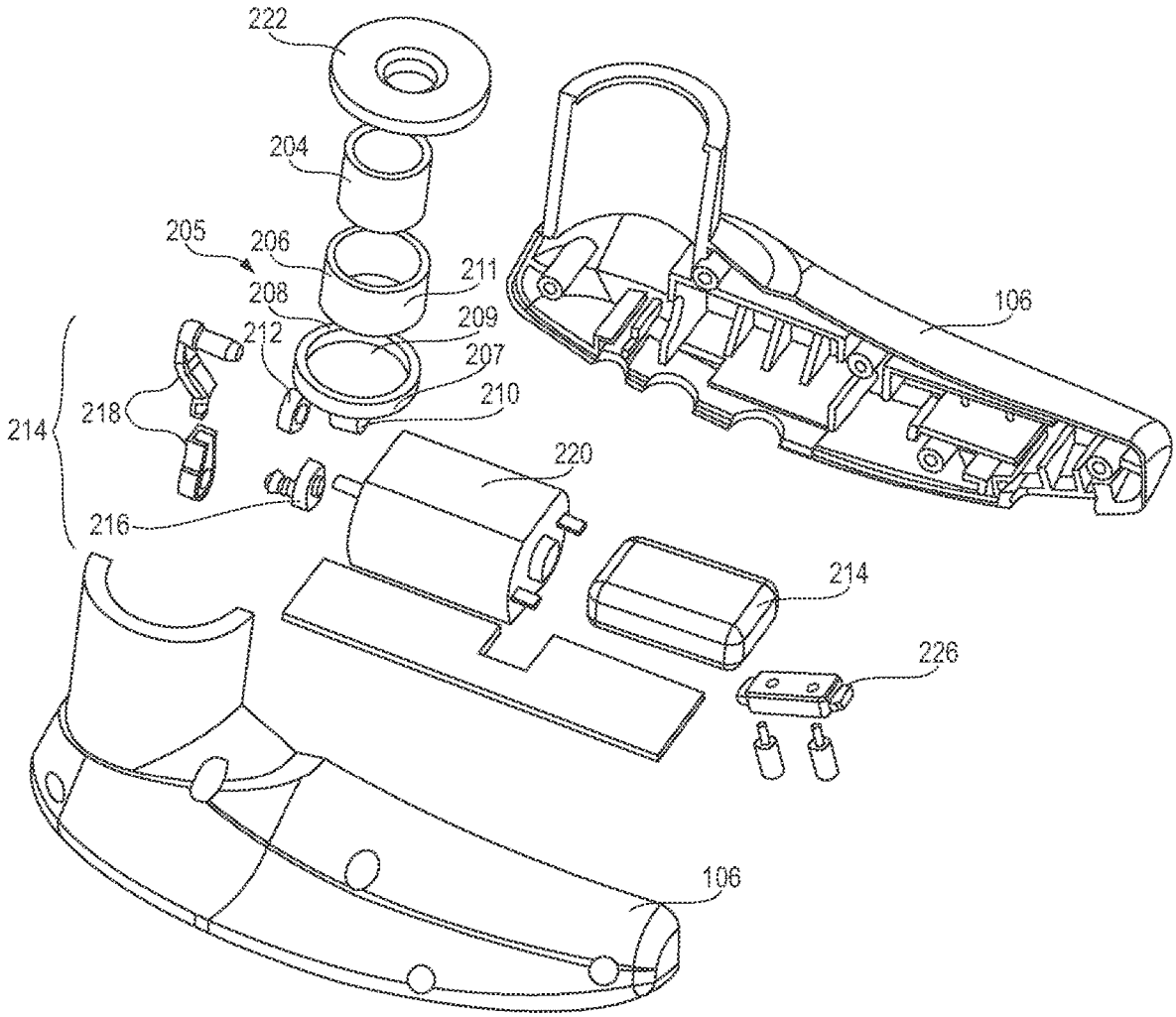
FIG. 2 illustrates an exploded view of the stimulation device of FIG. 1.

FIG. 2 illustrates an exploded view of the stimulation device 100 of FIG. 1. FIG. 2 illustrates the housing 106 that encloses several components of the stimulation device 100. The pressure generator 102 includes a stationary sleeve 204 and a movable container 205. The movable container 205 includes a motional sleeve 206 and a bottom wall 208 fixed at the bottom of the motional sleeve 206. The motional sleeve 206 is disposed between the stationary sleeve 204 and the bottom wall 208. Moreover, the motional sleeve 206 sockets the stationary sleeve 204. The stationary sleeve 204 and the motional sleeve 206 are made of metal, whereas the bottom wall 208 and the outer edges of the motional sleeve 206 are assembled by wrapping a layer of plastic. The bottom wall 208 can be made up of plastic and includes a side wall 207 surrounding a bottom 209. The side wall 207 extends upwards from the bottom 209 of the bottom wall 208. The side wall 207 also sockets at least a portion of a lateral wall 211 of the motional sleeve 206, making the motional sleeve 206 and the bottom wall 208 easy to assemble into the movable container 205.

The bottom wall 208 further includes a bearing fixator 210 at the bottom 209 of the bottom wall 208. The bearing fixator 210 receives a bearing 212. The bearing 212 may be a roller bearing or a thrust bearing or the like. Further, enclosed in the housing 106 is a linear reciprocating mechanism 214. The linear reciprocating mechanism 214 in the current embodiment is a crank-link mechanism and includes a crank 216 and a connecting rod 218. The crank 216 is rotatably connected with a drive unit 220 and the connecting rod 218 is rotatably connected with the crank 216. In the given example embodiment, the drive unit 220 is a motor. In several alternate embodiments, the linear reciprocating mechanism 214 may include ball screw mechanism, belt-drive linear actuator, linear motor, slider-crank mechanism, hydraulic linear actuator and pneumatic linear actuator.

One end of the connecting rod 218 rotatably connected with the crank 216. Another end of the connecting rod 218 is received in the bearing 212 of the bearing fixator 210. In this manner, the connecting rod 218 of the crank-link mechanism is connected with the bottom of the movable container 205. Thereby, the movable container 205 reciprocates as and when the crank 216, of the crank-link mechanism, rotates with the drive unit 220 which in this case is a motor. The housing 106 further encloses the drive unit 220. In several embodiments of the disclosure, the drive unit 220 is an AC or DC electrical motor. The crank 216 is rotationally connected with the drive unit 220. In that regard, the rotation of the drive unit 220 causes rotation of the crank 216. The rotation of the crank 216 is converted into rotational and reciprocating motion of the connecting rod 218. The rotational and reciprocating motion of the connecting rod 218 results in the reciprocating motion of the bottom wall 208 via the bearing 212 and the bearing fixator 210. The reciprocating motion of the bottom wall 208 results in reciprocating motion of the motional sleeve 206 and consequently, the reciprocating motion of the movable container 205.

Further, a holding gasket 222 has been fixed at the bottom of the opening 104, within the housing 106, and the stationary sleeve 204 is fixed at the bottom of the holding gasket 222, also within the housing 106. As the motional sleeve 206 sockets the stationary sleeve 204 and the bottom wall 208 reciprocates, the motional sleeve 206 is proximal to the holding gasket 222 when the bottom wall 208 moves to the top of the reciprocating motion, and the motional sleeve 206 is distal to the holding gasket 222 when the bottom wall 208 moves to the bottom of the reciprocating motion. The holding gasket 222 seals the housing 106 at the opening 104. The drive unit 220 is configured to be powered using a battery 224 that is chargeable via a charging port 226. In that regard, the battery 224 may be a Nickel-Metal-Hydride battery, a Lithium-Ion battery, a Lithium-polymer battery or the like.

Figure 3:
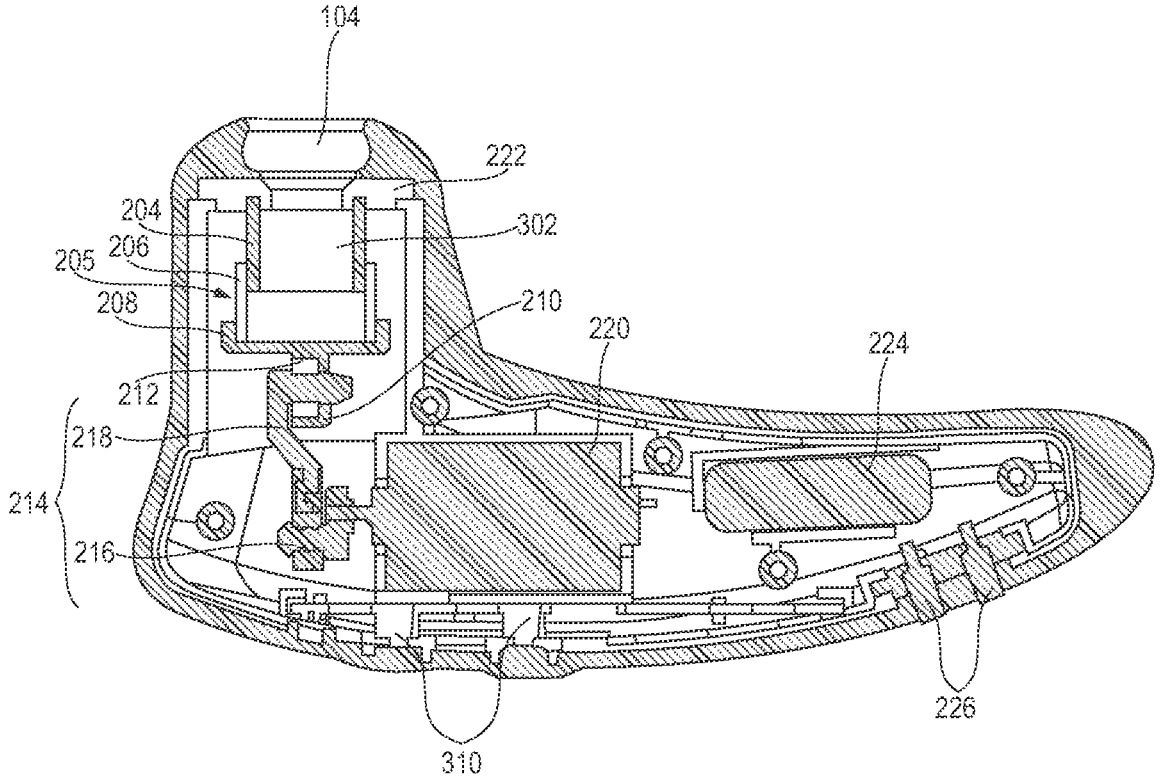
FIG. 3 illustrates a sectional view of the stimulation device of FIG. 1.

FIG. 3 illustrates a sectional view of the stimulation device 100 of FIG. 1. The stationary sleeve 204 and the motional sleeve 206 are concentric with each other and define a chamber 302 with the bottom wall 208. The stationary sleeve 204 is socketed by the motional sleeve 206 and therefore the stationary sleeve 204 is also socketed by the movable container 205. The bottom wall 208 is fixed in the bottom of the motional sleeve 206, thereby sealing the opening under the motional sleeve 206. Moreover, the side wall 207 of the bottom wall 208 at least partially sockets the motional sleeve 206. The stationary sleeve 204 remains fixated with the holding gasket 222 and the motional sleeve 206 is configured to reciprocate with the bottom wall 208. As also discussed through FIG. 2, the motional sleeve 206 is proximal to the holding gasket 222 when the bottom wall 208 reaches a top of the reciprocating motion and distal to the holding gasket 222 when the bottom wall 208 reaches a bottom of the reciprocating motion. As the motional sleeve 206 reciprocates with the bottom wall 208, the motional sleeve 206 keeps socketing at least a portion of the stationary sleeve 204, such that, the motional sleeve 206 moves in the longitudinal axis along the outside lateral wall of the stationary sleeve 204. As the crank 216 rotates and the bottom wall 208 is pulled downwards by the connecting rod 218 via the bearing fixator 210, the motional sleeve 206 also moves downwards with respect to the stationary sleeve 204, while socketing at least a portion of the stationary sleeve 204. The downwards movement of the motional sleeve 206 creates a negative pressure in the chamber 302.

The opening 104 is the sole opening of the chamber 302 to the exterior of the pressure generator 102. Moreover, the opening 104 is connected to the stationary sleeve 204 and therefore is in fluidic communication with the stationary sleeve 204. The downwards motion of the motional sleeve 206 also causes the volume of the chamber 302 to increase. FIG. 3 also illustrates a control device 310 configured to receive an input from a user and control the drive unit 220. In the current embodiment, the control device 310 is a button. The button located on the housing 106 is used to activate the rotation of the drive unit 220 and/or to change the rotation state. In several alternate embodiments, the control device 310 may include a processor, a memory unit, and a communication interface. Further, the control device 310 may be configured to connect with an external communication device through the communication interface and receive an input for the control of characteristics of the drive unit 220 from the external communication device.

Figure 4:
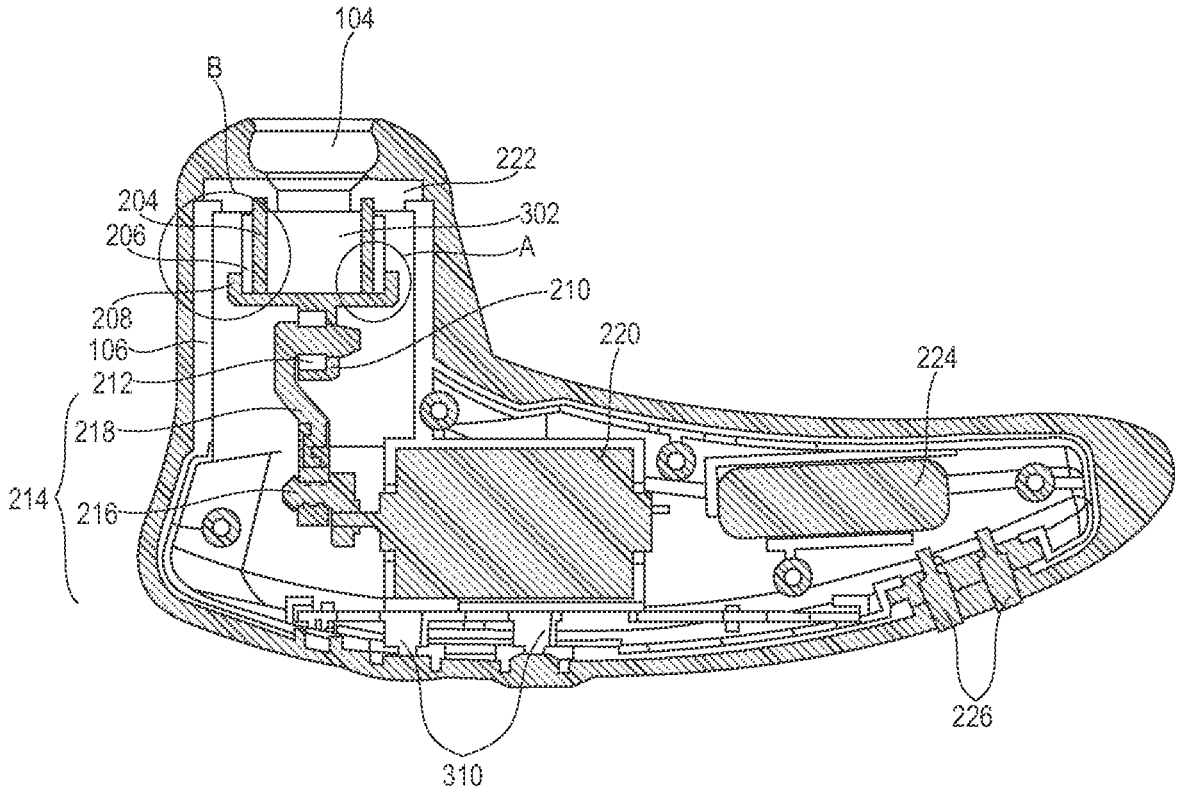
FIG. 4 illustrates a sectional view of the stimulation device of FIG. 1 with a positive pressure in a chamber defined by a stationary sleeve, a motion sleeve and a bottom wall.

FIG. 4 illustrates a sectional view of the stimulation device 100 of FIG. 1 with a positive pressure in the chamber 302. The positive pressure is created as the crank 216 rotates and the bottom wall 208, the motional sleeve 206, and hence the movable container 205 move upwards via the bearing fixator 210. As the bottom wall 208 moves upwards, the movable container 205 also moves upwards. As the bottom wall 208 moves upwards, the motional sleeve 206 also moves upwards remaining concentric to the stationary sleeve 204, while also socketing the stationary sleeve 204. The upwards motion of the motional sleeve 206 leads to reduction in the volume of the chamber 302 and the generation of the positive pressure in the chamber 302. The changing volume of the chamber 302 due to rotational motion of the drive unit 220 and reciprocating motion of the bottom wall 208, the motional sleeve 206, and the movable container 205 creates a suction effect inside the pressure generator 102 with alternating positive and negative relative pressures with respect to the ambient.

Figure 5:
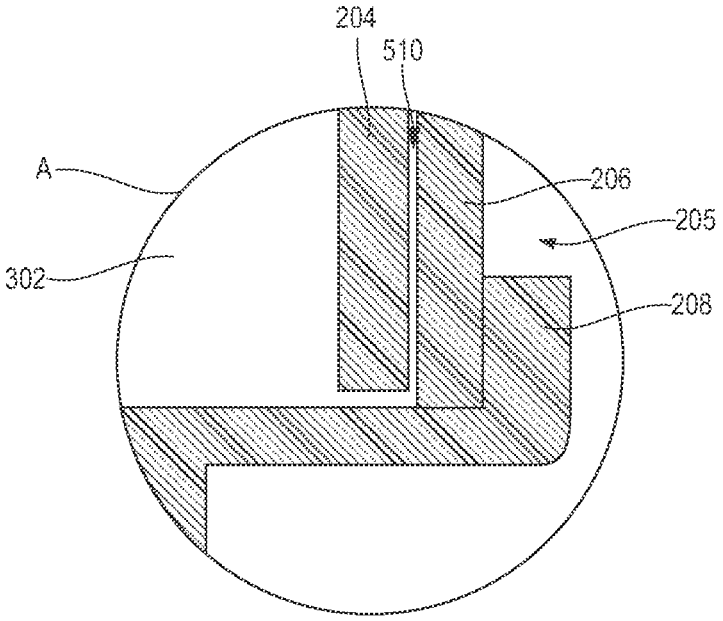
FIG. 5 illustrates a magnified view of a portion 'A' of FIG. 4.

FIG. 5 illustrates a magnified view of a portion 'A' of FIG. 4. The stationary sleeve 204, the motional sleeve 206 and the bottom wall 208 together define the chamber 302. The motional sleeve 206 and the bottom wall 208 together define the movable container 205 that sockets the stationary sleeve 204. FIG. 5 further illustrates a first gap 510 between the stationary sleeve 204 and the motional sleeve 206. The first gap 510 is also a gap between the stationary sleeve 204 and the movable container 205. In an embodiment of the disclosure, the width of the first gap 510 between the stationary sleeve 204 and the motional sleeve 206 (or the movable container 205) is less than 0.1 mm. In an embodiment of the disclosure, the width of the first gap 510 lies in the range of 0.02 to 0.05 mm.

Figure 6:
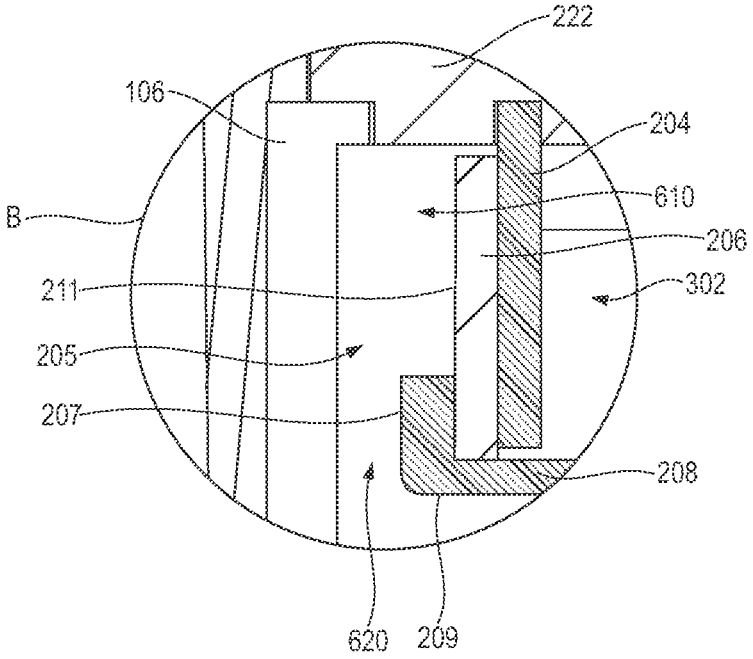
FIG. 6 illustrates a magnified view of a portion 'B' of FIG. 4.

FIG. 6 illustrates a magnified view of a portion 'B' of FIG. 4. The stationary sleeve 204 is concentric with the motional sleeve 206 and is socketed by the motional sleeve 206. Further, the stationary sleeve 204 and the motional sleeve 206 define the chamber 302 with the bottom wall 208. The motional sleeve 206 and the bottom wall 208 together define the movable container 205. The stationary sleeve 204 is held stationary with the housing 106 via the holding gasket 222. The stationary sleeve 204, the motional sleeve 206, and the bottom wall 208 are enclosed by the housing 106. FIG. 6 further illustrates a second gap 610 between the motional sleeve 206 and an inner wall of the housing 106. The second gap 610 also therefore represents a gap between the inner wall of the housing 106 and the movable container 205. The second gap 610 also represents a gap between the inner wall of the housing 106 and the lateral wall 211 of the motional sleeve 206. In an embodiment of the disclosure, a width of the second gap 610 between the motional sleeve 206 and the inner wall of the housing 106 is greater than 0.1 mm and preferably greater than 1 mm FIG. 6 also illustrates a third gap 620 between the bottom wall 208 and the inner wall of the housing 106. The third gap 620 also represents a gap between the side wall 207 of the bottom wall 208 and the inner wall of the housing 106. In an embodiment of the disclosure, a width of the third gap between the bottom wall 208 and the inner wall of the housing 106 is greater than 0.1 mm and preferably greater than 1 mm.

Figure 7:
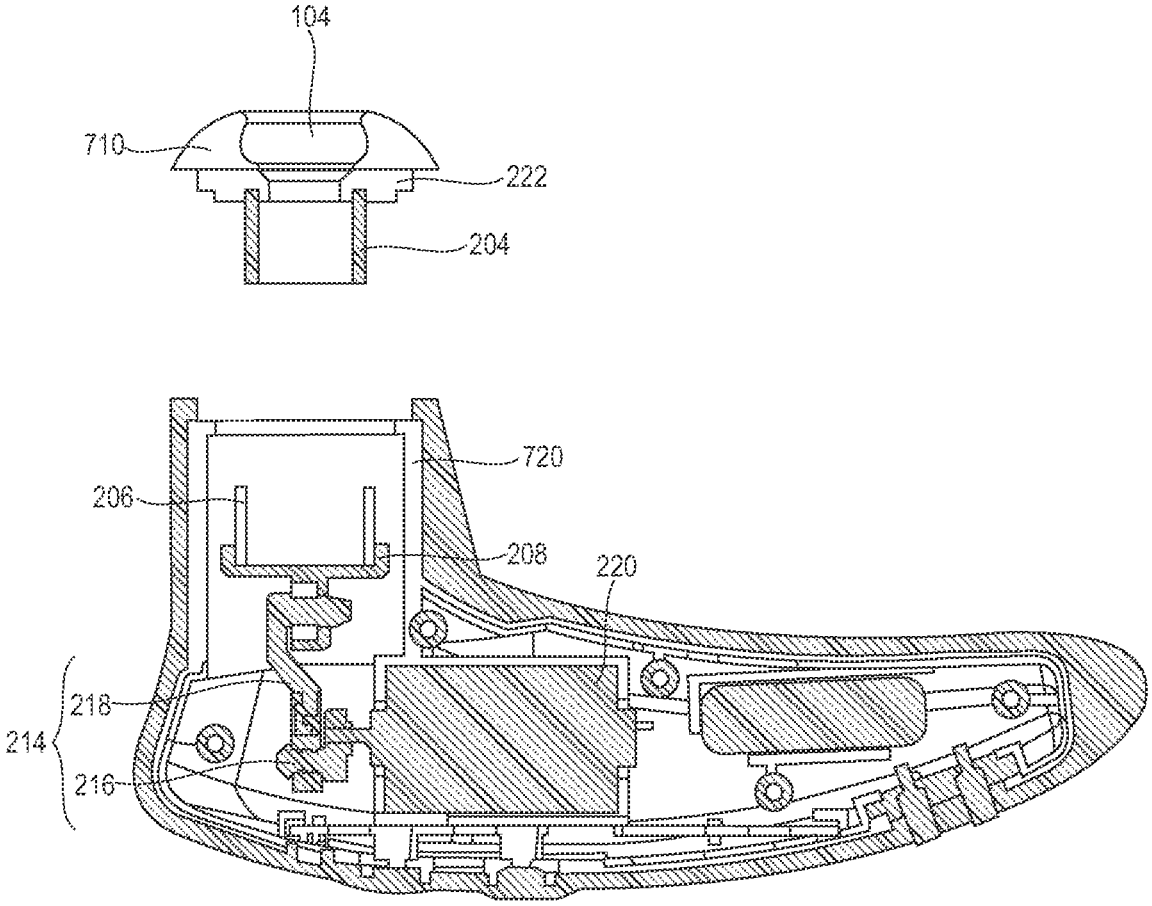
FIG. 7 illustrates the stimulation device in accordance with another embodiment of the present disclosure.

FIG. 7 illustrates the stimulation device 100 in accordance with another embodiment of the present disclosure. The drive unit 220 is a motor. Further, the pressure generator 102 includes the stationary sleeve 204, the motional sleeve 206, and the bottom wall 208. The motional sleeve 206 and the bottom wall 208 together define the movable container 20 that along with the motional sleeve 206 sockets the stationary sleeve 204. The linear reciprocating mechanism 214 is the crank link mechanism. The bottom wall 208 is fixed in the bottom of the motional sleeve 206, thereby sealing an opening under the motional sleeve 206. Further, the stationary sleeve 204 is concentric with the motional sleeve 206 and the motional sleeve 206 is located between the stationary sleeve 204 and the bottom wall 208. The stationary sleeve 204 is held with the housing 106 via holding gasket 222. Further, a portion 710 of the housing 106 associated with the holding gasket 222 and the stationary sleeve 204 is detachable from the main body 720 of the housing 106. The detachable portion 710 allows for easier access to the pressure generator 102 for cleaning, and repair and reconstruction. In one embodiment, the portion 710 of the housing 106 may be attached to the main body 720 using magnetic fasteners. In another embodiment, the portion 710 of the housing 106 may be attached to the main body 720 using clips-based snap-fit fasteners, or the portion 710 of the housing 106 may be attached to the main body 720 using threaded fasteners.

Advantages of the Disclosed Embodiments

The pressure field, created by negative and positive relative pressures, excites the blood circulation of the area of skin to be stimulated, while said area of skin is indirectly massaged, thus combining two advantageous effects. The increased blood circulation makes the erogenous zone of the person concerned more sensitive, while generating an additional massage effect that serves, for example, to stimulate the erogenous zone to sexual arousal up to climax.

By the exemplary use of the temporally modifiable pressure field on the clitoris, the pressure field imitates a stimulation that usually only occurs during sexual intercourse. Likewise, the cohabitation movement generates a varying stimulus on the clitoris. It is thus a true-to-life imitation of the natural act of cohabitation, with the use of the pressure field causes neither habituation effects nor addiction. This is due in particular to the alternating use of negative- and positive-pressures (or even to the noncontinuous use of only one type of pressure).

Furthermore, the maximum applicable pressure is regularly limited by the maximum resilience of the area of skin to be stimulated. Thus, for instance, too high a negative-pressure harbors the risk of painful injury, especially in erogenous zones. Only stimulation devices working with negative-pressures are usually limited to this maximum in their mode of operation. Conversely, the combination of positive- and negative-pressures creates an extended working area of the stimulation-triggering pressure field or effect, as the working area of the pressure can now be exploited to the maximum in both the positive and negative area.

Various embodiments of the disclosure, as discussed above, may be practiced with steps and/or operations in a different order, and/or with hardware elements in configurations, which are different from those which are disclosed. Therefore, although the disclosure has been described based on these exemplary embodiments, it is noted that certain modifications, variations, and alternative constructions may be apparent and well within the scope of the disclosure.

The invention claimed is:

1. A stimulation device, the stimulation device comprising:

a pressure generator comprising a chamber and an opening being a sole opening of the chamber to an exterior of the pressure generator, wherein the chamber is defined by a movable container and a stationary sleeve socketed by the movable container, the opening configured to engage a portion of a body of a user, wherein an inner wall of the movable container contacts an outer lateral wall of the stationary sleeve as the movable container is gliding in a direction of a longitudinal axis defined along the outer lateral wall of the stationary sleeve; and a drive unit and a linear reciprocating mechanism, wherein the drive unit is configured to cause reciprocating motion of the movable container via the linear reciprocating mechanism, thereby resulting in a changing volume of the chamber.

2. The stimulation device as claimed in claim 1, wherein a width of a gap between the stationary sleeve and the movable container is less than 0.1 mm.

3. The stimulation device as claimed in claim 2, wherein the width of the gap between the stationary sleeve and the movable container lies in the range of about 0.02 mm to 0.05 mm.

4. The stimulation device as claimed in claim 1, further comprising a housing enclosing the drive unit, the linear reciprocating mechanism, and a part of the pressure generator.

5. The stimulation device as claimed in claim 4, wherein the movable container comprises a motional sleeve and a bottom wall fixed at a bottom of the motional sleeve, and wherein a width of a gap between the motional sleeve and an inner wall of the housing is greater than 0.1 mm.

6. The stimulation device as claimed in claim 1, wherein the stationary sleeve and the motional sleeve are made of metal, and the bottom wall and outer edges of the motional sleeve are assembled by wrapping a layer of plastic.

7. The stimulation device as claimed in claim 1, wherein a bottom wall at a bottom of the motional sleeve is made of plastic and comprises a side wall surrounding a bottom of the bottom wall, such that the side wall sockets a portion of a lateral wall of the motional sleeve.

8. The stimulation device as claimed in claim 7, wherein a width of a gap between the side wall of the bottom wall and an inner wall of the housing is greater than 0.1 mm.

9. The stimulation device as claimed in claim 4, wherein the stationary sleeve is held within the housing via a holding gasket, a portion of the housing associated with the holding gasket and the stationary sleeve being detachable for accessing the pressure generator.

10. The stimulation device as claimed in claim 1, wherein the opening is connected to the stationary sleeve.

11. The stimulation device as claimed in claim 1, wherein the drive unit is a motor and the linear reciprocating mechanism is a crank-link mechanism, a connecting rod of the crank-link mechanism is connected with a bottom of the movable container, thereby causing the movable container to reciprocate when a crank of the crank-link mechanism is rotating with the motor.

12. The stimulation device as claimed in claim 11, wherein the connecting rod of the crank-link mechanism is connected with a bottom of the bottom wall, thereby causing the motional sleeve to reciprocate when the crank of the crank-link mechanism is rotating with the motor, and keep socketing a portion of the stationary sleeve.

13. The stimulation device as claimed in claim 10, wherein the stationary sleeve and the motional sleeve are concentric with each other, the motional sleeve is proximal to a holding gasket when a bottom wall at a bottom of the motional sleeve moves towards the opening, the motional sleeve is distal to the holding gasket when the bottom wall moves away from the opening.

14. The stimulation device as claimed in claim 1, further comprising a control device configured to receive input from a user and control the drive unit.

15. A stimulation device, the stimulation device comprising:

a pressure generator comprising a chamber and an opening being a sole opening of the chamber to an exterior of the pressure generator, the chamber is defined by a motional sleeve, a bottom wall fixed at a bottom of the motional sleeve, and a stationary sleeve socketed by the motional sleeve, wherein the motional sleeve is disposed between the stationary sleeve and the bottom wall, such that, the stationary sleeve and the motional sleeve are concentric with each other, the opening configured to engage a portion of a body of a user, wherein an inner wall of the motional sleeve glides in a direction along a longitudinal axis defined along an outer lateral wall of the stationary sleeve; and a drive unit and a linear reciprocating mechanism, wherein the drive unit is configured to cause reciprocating motion of the bottom wall via the linear reciprocating mechanism, the motional sleeve keeps socketing a portion of the stationary sleeve, thereby resulting in a changing volume of the chamber.

16. The stimulation device as claimed in claim 15, wherein a width of a gap between the stationary sleeve and the motional sleeve is less than 0.1 mm.

17. The stimulation device as claimed in claim 15, further comprising a housing enclosing the drive unit, the linear reciprocating mechanism, and a part of the pressure generator, the stationary sleeve is held within the housing via a holding gasket, wherein a portion of the housing associated with the holding gasket and the stationary sleeve being detachable for accessing the pressure generator.

18. The stimulation device as claimed in claim 15, wherein the drive unit is a motor and the linear reciprocating mechanism is a crank-link mechanism, a connecting rod of the crank-link mechanism is connected with a bottom of the bottom wall, thereby causing the motional sleeve and the bottom wall to reciprocate when a crank of the crank-link mechanism is rotating with the motor.

* * * * *